US005348192A

United States Patent [19]

Sardynski et al.

[11] Patent Number: 5,348,192

[45] Date of Patent: Sep. 20, 1994

[54] DISPENSER VALVE

[75] Inventors: Gary F. Sardynski, Medford; Paul E. Cox, Brighton; Gilbert R. Pacheco, Plymouth, all of Mass.

[73] Assignee: Jet Spray Corp., Norwood, Mass.

[21] Appl. No.: 60,604

[22] Filed: May 12, 1993

[51] Int. Cl.[5] ..... B67D 5/56

[52] U.S. Cl. ..... 222/129.1; 222/148; 222/505; 137/240; 137/864; 251/142; 251/253

[58] Field of Search ..... 222/66, 105, 129.1, 222/148, 505, 506, 507, 508, 509, 518; 251/142, 149.9, 253; 137/240, 864, 868

[56] References Cited

U.S. PATENT DOCUMENTS

| | | | |
|---|---|---|---|
| 1,954,986 | 4/1934 | Carlson et al. | 251/253 |
| 3,753,442 | 8/1973 | Tauber | 251/149.9 X |
| 4,181,143 | 1/1980 | Fallon | 251/149.9 X |
| 4,316,557 | 2/1982 | Benoun et al. | 222/129.1 |
| 4,582,295 | 4/1986 | Kugler et al. | 251/149.9 X |
| 4,856,676 | 8/1989 | Emody | 222/129.1 |
| 4,946,135 | 8/1990 | Yang | 251/253 |
| 5,000,348 | 3/1991 | Emody | 222/129.1 X |
| 5,114,047 | 5/1992 | Baron et al. | 222/129.1 |
| 5,275,309 | 1/1994 | Baron et al. | 222/129.1 |

FOREIGN PATENT DOCUMENTS

| | | | |
|---|---|---|---|
| 9203347 | 3/1992 | World Int. Prop. O. | 222/129.1 |

*Primary Examiner*—Andres Kashnikow
*Assistant Examiner*—Lesley D. Morris
*Attorney, Agent, or Firm*—Wolf, Greenfield & Sacks

[57] ABSTRACT

A beverage dispenser as provided for use with a container which has an adapter with a resealable valve, which is a ball valve. The dispenser has a valve which includes an engaging mechanism, such as a pin for mechanically opening the valve in the adapter. Preferably, the dispenser valve has a handle for rotatable motion, causing an engaging pin to vertically move in contact with the ball valve, thus opening the container such that its contents can flow. The dispenser valve may also be provided with a rinse water conduit and an opening so that the user can selectively close the adapter valve and rinse the dispenser system.

12 Claims, 6 Drawing Sheets

DISPENSER VALVE

BACKGROUND OF THE INVENTION

This invention relates to a valve for use in a beverage dispensing device.

Concentrated juices, such as orange juice or lemonade, may be shipped frozen in a plastic container which is disposable or refillable. One type of container which is used to ship concentrated juice has a threaded opening onto which an adapter with a ball valve is screwed. The adapter has a threaded portion at one end, and a reduced diameter cylindrical portion with a spring mounted ball valve at the end opposite the threaded portion.

A dispenser concentrate control valve for a bag-in-box type of container is available from Jet Spray Corp. of Norwood, Mass., and is described in U.S. Pat. Nos. 4,856,676 and 5,000,348, each of which are assigned to the same assignee as the present invention, and each of which are expressly incorporated by reference.

To install this general type of valve with a container, a cap is unscrewed and discarded. The valve has a threaded portion or a threaded adapter which can be screwed onto the threaded opening of the container. With the adapter and ball valve arrangement, the adapter would be discarded, and the valve screwed on with its own adapter.

A drawback of this arrangement is that a user, such as an employee in a restaurant or diner, must remove the adapter and add the dispenser valve each time a new container is used. Many restaurants have a fast-paced environment so restaurant managers do not want to expend any extra time and effort replacing food items.

Another arrangement that has been used with a ball valve includes a stationary pin which contacts the ball valve when the container is inserted. With this arrangement, it is cumbersome to rinse the system since the flow of juice cannot be stopped unless the container is removed. This, too, is a cumbersome system and is undesirable in the fast-paced food service environment.

SUMMARY OF THE INVENTION

The invention features a beverage dispenser for use with a container for holding a concentrated beverage. The container has an adapter which is resealably actuable between an open position for allowing the beverage to flow from the container and a closed position for containing the beverage. The dispenser has a housing with a chamber for holding a container in a fixed position, and a dispenser valve which includes an engaging mechanism for engaging the adapter, and a manually actuable switch operable between a first position in which the engaging means causes the adapter to be in an open position and a second position in which the adapter is maintained in a closed position. The concentrated beverage is then combined with water.

In preferred embodiments, the adapter has a spring loaded ball valve, and the engaging mechanism includes a pin. In the dispenser, the switch is a rotatable switch for causing the pin to move vertically. The dispenser also comprises a conduit for providing rinse water into the dispenser valve through an opening in the valve. The opening is aligned with the conduit when the adapter is in the closed position, and is out of alignment with the conduit when the adapter is in a closed position.

In another aspect, the invention features a beverage dispenser for use with a concentrated juice container which has an adapter with a ball valve at the bottom of the container. The dispenser has a housing with a chamber for holding a container in a stationary position when the container is inserted. A dispenser valve is mounted in the housing and has a pin which is vertically actuatable to a first position in which the pin is spaced from the ball valve so that the juice is contained, and a second position in which the pin engages the ball valve to allow the concentrated juice to flow from the container. A switch is provided for moving the pin between the first and second positions. A conduit provides water from a water supply; and the water and the concentrated juice are combined. A tap provides the combined water and concentrated juice to a user.

In preferred embodiments, the dispenser further comprises a second conduit for providing rinse water to the dispenser valve. The dispenser valve has a movable portion with an opening for receiving water from the second conduit when the opening is aligned with the conduit. This occurs when the pin is in the first position. The dispenser valve has a stationary outer sleeve with grooves and a rotatable inner sleeve with radial pins which mate with the grooves when the inner sleeve is inserted in the outer sleeve. The inner sleeve has a radially extending handle. The chamber in the dispenser can holds a plurality of containers, in which case the dispenser has an equal plurality of dispenser valves.

BRIEF DESCRIPTION OF THE DRAWINGS

Other features and advantages will become apparent from the following description of preferred embodiments and from the claims when read in conjunction with the drawings in which:

DESCRIPTION OF THE PREFERRED EMBODIMENT

Figure 1:
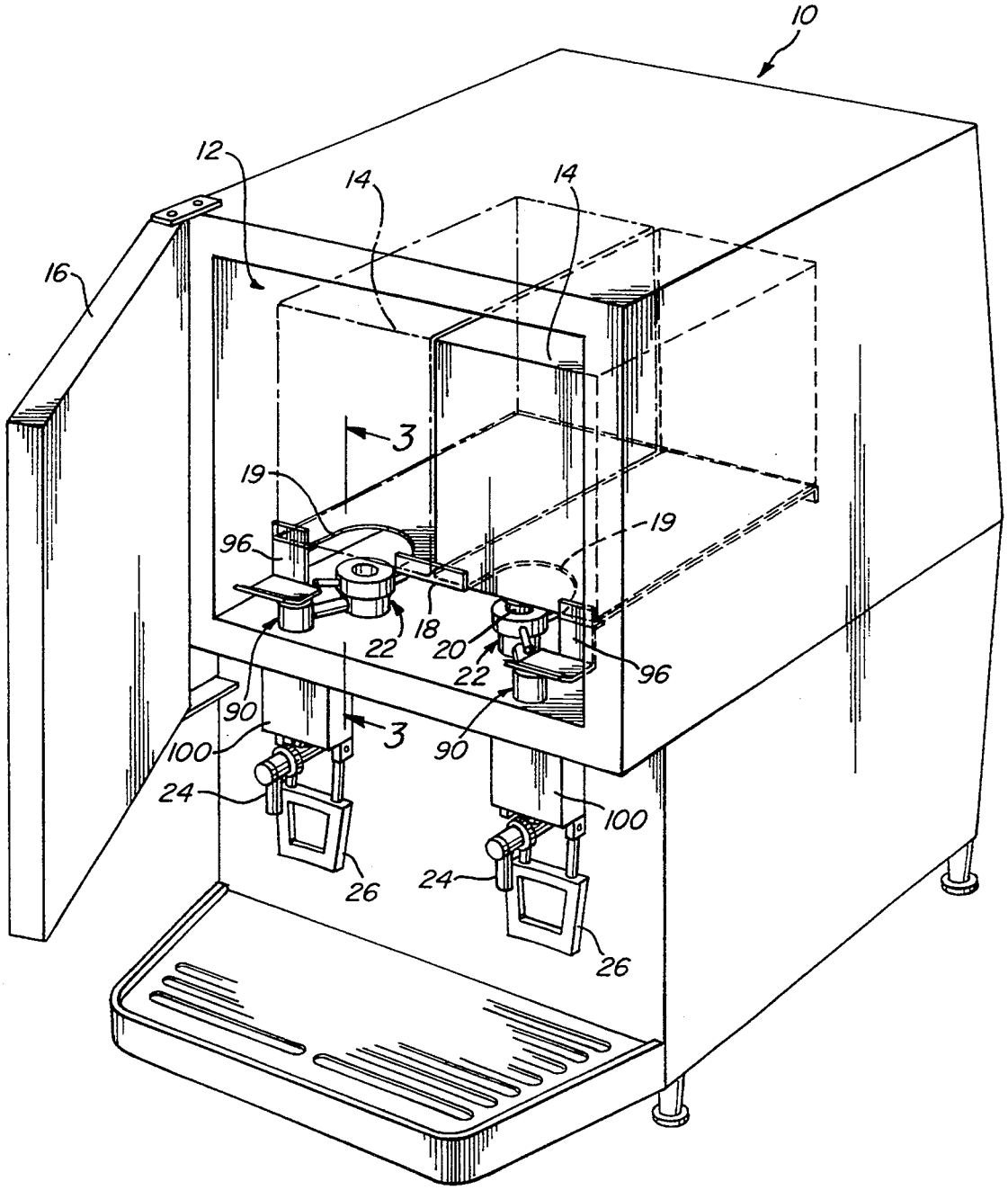
FIG. 1 is a perspective view of a beverage dispenser according to the present invention.

Referring to FIG. 1, a beverage dispenser 10 has a refrigerated chamber 12 for holding one or more beverage containers 14. The containers are placed on a horizontal shelf 18 in the chamber through a hinged front door 16. The shelf has slots 19 positioned to correspond to where an adapter 20 extends vertically downward.

Figure 2:
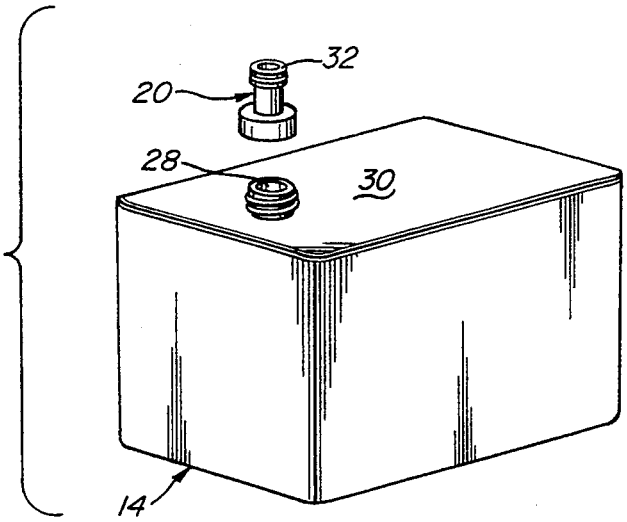
FIG. 2 is a perspective view of a container and adapter.

Referring to FIG. 2, container 14 has a threaded opening 28 in the bottom surface 30 (the container is shown upside down). Adapter 20 has a threaded portion at one end which screws over opening 28. At the other end 32 is a ball valve which keeps the liquid in the container.

Referring again to FIG. 1, adapter 20 mates with a concentrate control dispenser valve 22 which can be resealably opened or closed to allow a liquid in the container to flow. The concentrate is then mixed with water before being provided to a tap 24. To get juice from the dispenser, a user presses a glass against a switch 26 which causes the tap 24 to dispense combined water and concentrated juice. As an alternative to switch 26, a measured portion can be obtained by pushing a button (not shown).

Figure 3:
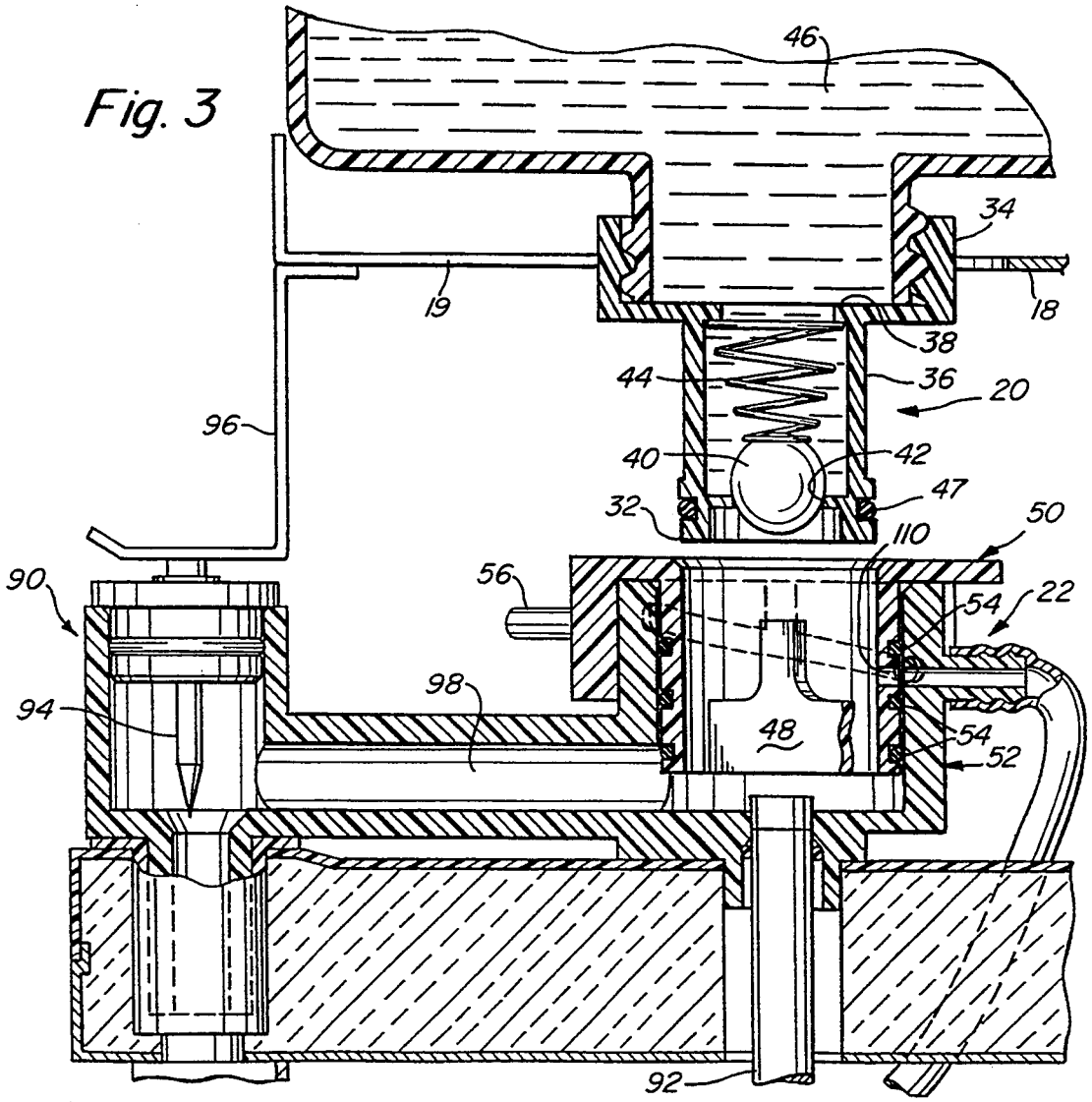
FIGS. 3 is a partial cross-sectional view taken through the line 3—3 in FIG. 1.

Referring to FIG. 3, adapter 20 has a threaded portion 34 and a reduced diameter portion 36. At the shoulder between these two portions, a lip 38 extends into the interior of the adapter. Near the bottom of the adapter, a ball 40 is seated in an opening 42. A spring 44 is mounted between the ball and the lip, and keeps the ball pressed against the opening to seal the concentrated juice 46 in the container. An O-ring 47 is provided near the bottom to help seal the adapter when it is inserted in the valve 22.

The adapter is shown positioned over dispenser valve 22. Valve 22 has an engaging pin 48 which is mounted in a rotatable, cup-shaped, inner sleeve 50. The inner sleeve is mounted in a stationary outer sleeve 52, and is sealed by three O-rings 54. The inner sleeve has a radially extending handle 56 which is moved circumferentially to rotate the inner sleeve and the engaging pin relative to the outer sleeve.

Figure 4:
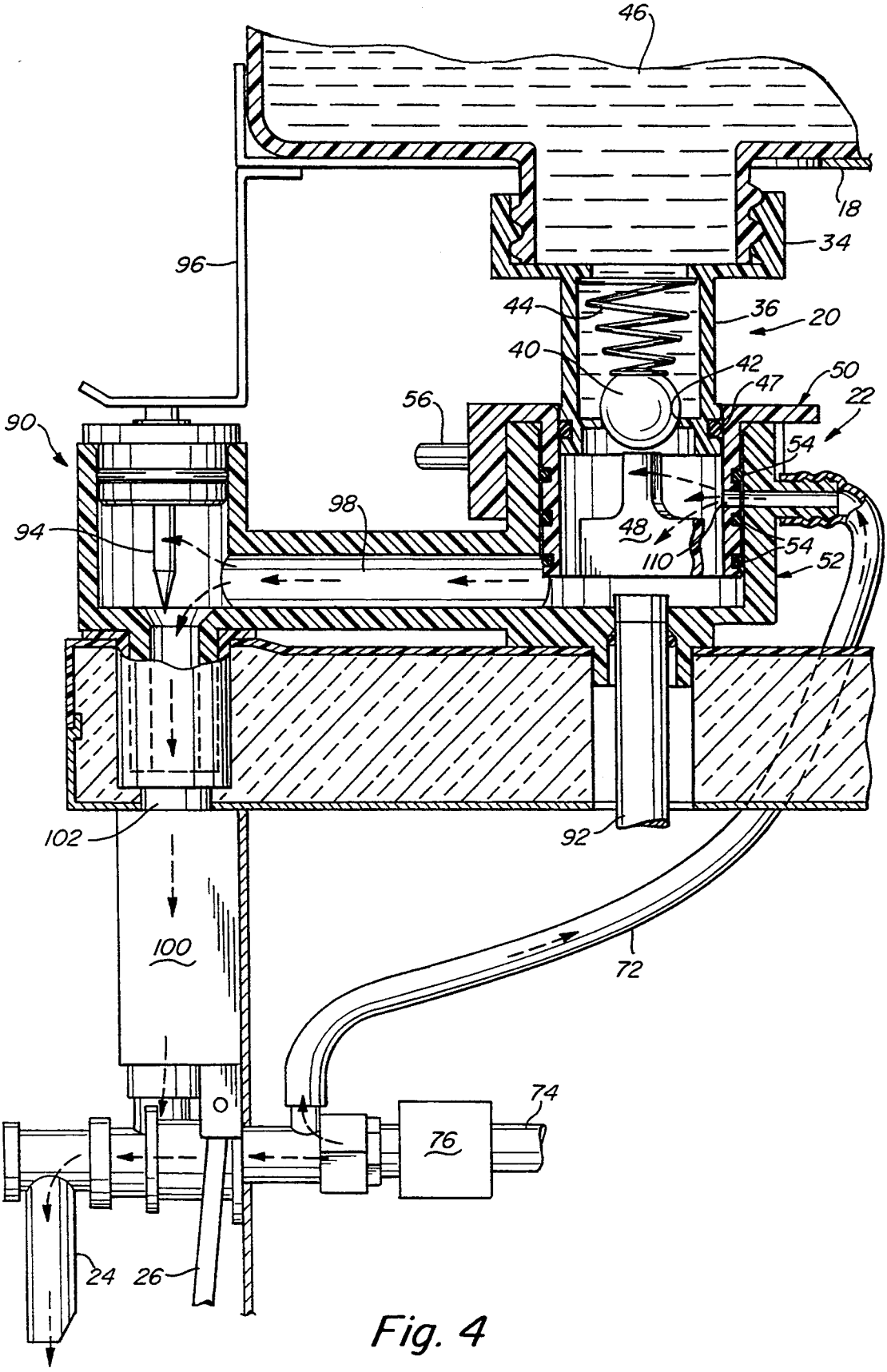
FIGS. 4 and 5 are partial cross-sectional views of a dispenser valve according to the present invention in rinse and run positions, respectively.
Figure 5:
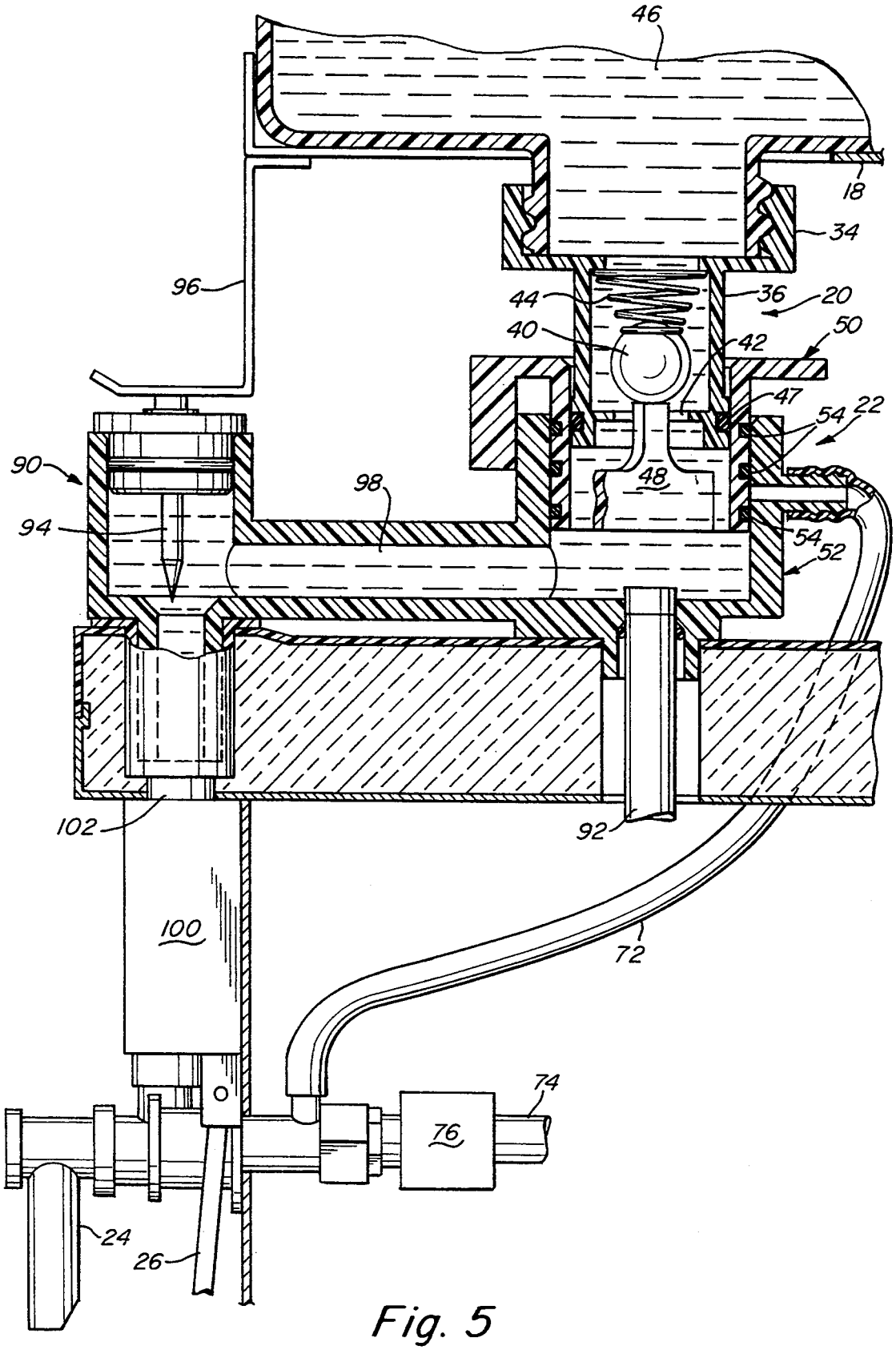

Referring to FIGS. 4 and 5, the dispensing valve is shown in rinse position and run position, respectively. When the dispensing valve is in the rinse position (FIG. 4), the adapter extends into the inner sleeve, but the engaging pin and the ball are spaced apart by a small distance. If a user desires to rinse the dispensing valve, rinse water can be provided by a rinse water conduit 72 through a rinse inlet opening 110 in the inner sleeve 50 between the top two O-rings 54 to flow through the dispensing valve, without being combined with juice 46.

Referring to FIG. 5, when the dispensing valve is in the run position, the inner sleeve is rotated by an actuating handle (not shown) which causes the inner sleeve and the engaging pin to rotate upward. As a result, the engaging pin pushes the ball away from the opening and compresses the spring. Pushing the ball allows juice to flow from the container into valve 22. At the same time, the rinse inlet opening 110 in the inner sleeve is moved out of alignment with rinse water conduit 72, so rinse water does not enter the valve. The rinse conduit is now positioned between the bottom two O-rings.

The concentrate is pumped by a pump 100. The pump, as described in U.S. Pat. Nos. 4,856,676 and 4,610,145 preferably has a pump head with an eccentric pump chamber connected to inlet 102. An impeller (not shown) has flexible, rotating names mounted in pump 100. The concentrated liquid is combined with water from a water line 74, through a solenoid valve 76, and is then provided to tap 24.

Referring to FIGS. 3–5, an out-of-juice sensor is provided for detecting when the concentrated juice is low. A sensor, such as that shown in the present application, is described in U.S. Pat. Nos. 4,856,676 and 4,645,095, each of which are assigned to the assignee of the present invention and are incorporated by reference. Sensor 90 includes a first electrode 92 and a second electrode 94 which is grounded to the shelf 18 through a contact 96. Under normal running operation (FIG. 5), the concentrate contacts both electrodes. Circuitry (not shown) detects a change in impedance when the juice is not in a channel 98 between the electrodes. The circuitry senses the change and provides a visual indication of the change.

Figure 6:
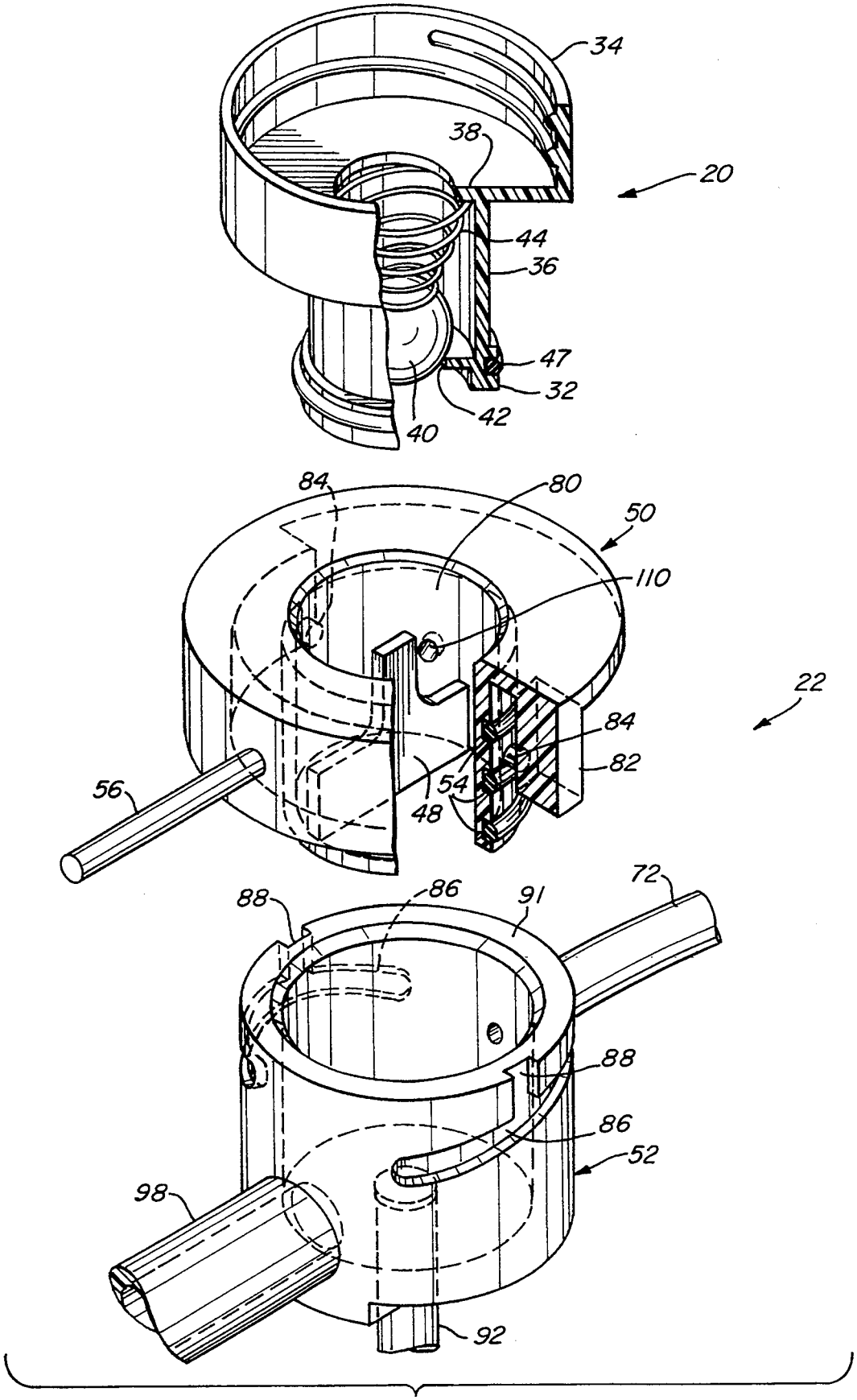
FIG. 6 is an exploded perspective view of the dispenser valve.

Referring to FIG. 6, an exploded view of the adapter and dispenser valve shows more detail. The inner sleeve of the dispenser valve has an inner cylindrical portion 80 and an overhanging portion 82. Two radial pins 84 extend from portion 82 toward portion 80. The outer sleeve has two upwardly slanting circumferential grooves 86, and two vertical grooves 88 extending from the top surface 91 to the middle of grooves 86. When assembled, the inner sleeve is placed over the outer sleeve so that pins 84 are aligned with vertical grooves 88. The inner sleeve is lowered and rotated so that the pins mate with grooves 86. When the handle is rotated, it causes the inner sleeve with the engaging pin to move relative to the outer sleeve as the pins move up or down in the grooves 86. Since the outer sleeve is held in a fixed position, the engaging pin is moved vertically to be in and out of contact with the ball valve without moving either the container or the outer sleeve.

Figure 7:
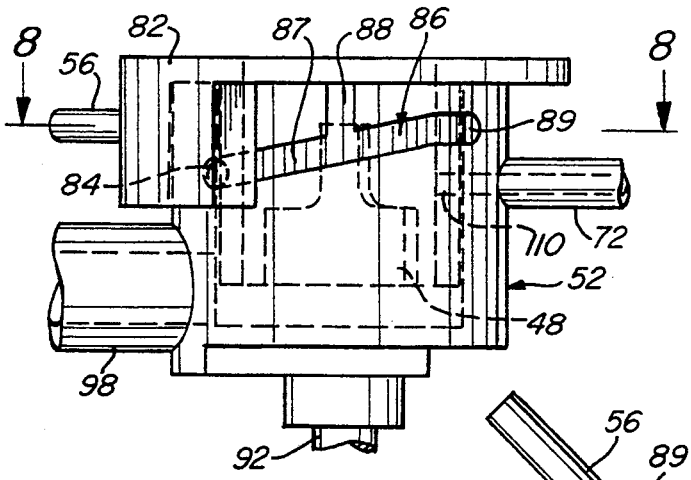
FIGS. 7 and 9 are side views of a dispenser valve in rinse and run positions, respectively.
Figure 8:
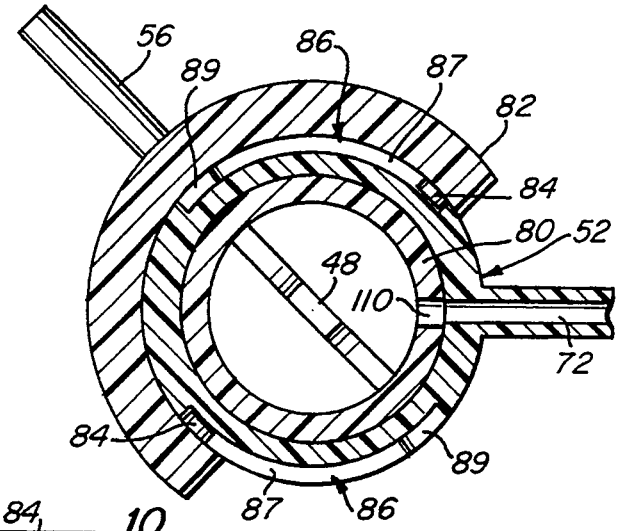
FIGS. 8 and 10 are cross-sectional views through the lines 8 and 10 in FIGS. 7 and 9, respectively.
Figure 9:
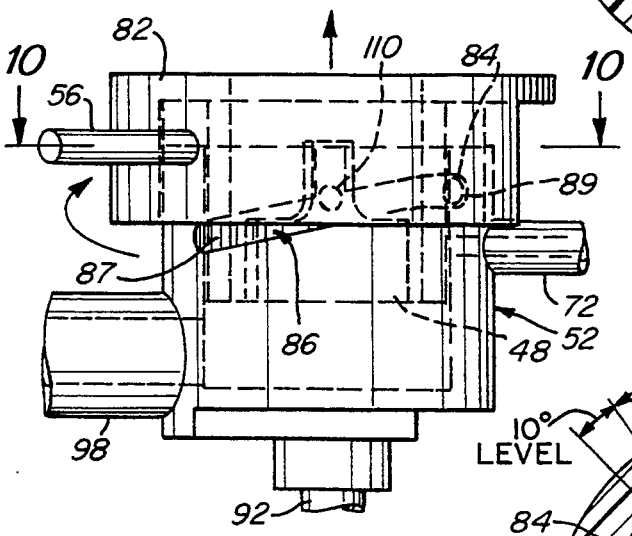
Figure 10:
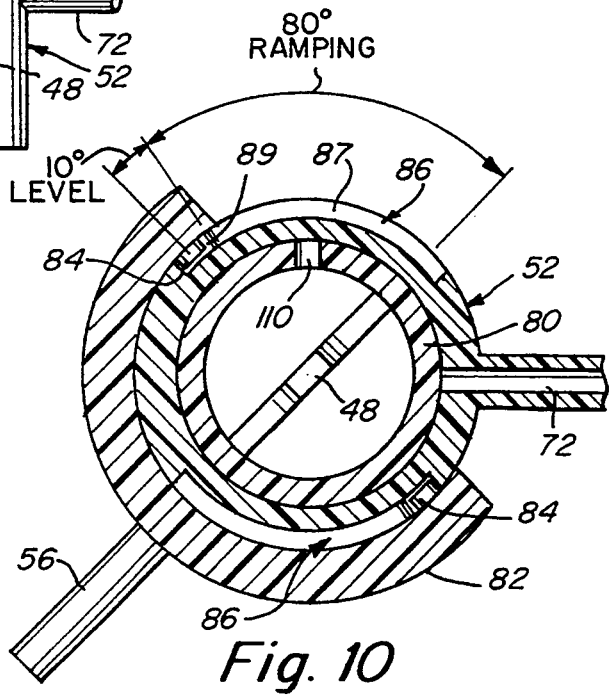

Referring to FIGS. 7 and 8, groove 86 has a ramp portion 90 and a level portion 92. The ramp portion 90 comprises a sector of about 80°, and level portion 92 is about a 10° sector. Accordingly, the handle has a total range of movement of about 90°. The level portion at the top of the groove helps to prevent the handle from rotating downward due to gravity or vibrations from the dispenser.

Having described an embodiment of the present invention, it will become apparent to those skilled in the art that other modifications can be made without departing from the scope of the appended claims. For example, the chamber can hold one container or many, and have corresponding pumps, sensors, and taps. Also other embodiments of the dispenser can be used, for example, different types of pumps, microproccessor control, and other features.

What is claimed is:

1. A beverage dispenser for use with a container for holding concentrated juice, the container having an adapter with a ball valve which is at the bottom of the container when the container is inserted in the dispenser, the dispenser comprising:

a housing having a chamber for holding a container in a stationary position when inserted;

a dispenser valve mounted in the housing, the dispensor valve including:

a pin which is vertically actuatable to a first position in which the pin is spaced from the ball valve so that the juice is contained and a second position in which the pin engages the ball valve to allow the concentrated juice to flow from the container, and a switch for moving the pin between the first and second positions;

a conduit for providing water from a water supply;

means for combining the water and the concentrated juice; and a tap for providing the combined water and concentrated juice.

2. The dispenser of claim 1 further comprising a second conduit for providing rinse water to the dispenser valve, wherein the dispenser valve has a moveable portion with an opening for receiving water into the dispenser valve from the second conduit when the opening is aligned with the conduit, the opening being aligned when the pin is in the first position.

3. The dispenser of claim 2 wherein the dispenser valve has a stationary outer sleeve with grooves and a rotatable inner sleeve with radial pins which mate with the grooves when the inner sleeve is inserted in the outer sleeve, the inner sleeve further comprising a radially extending handle.

4. The dispenser of claim 1 wherein the dispenser valve has a stationary outer sleeve with grooves and a rotatable inner sleeve with radial pins which mate with the grooves when the inner sleeve is inserted in the outer sleeve, the inner sleeve further comprising a radially extending handle.

5. The dispenser of claim 1 wherein the chamber holds a plurality of containers, the dispenser comprising an equal plurality of dispenser valves and pumps.

6. A beverage dispenser for use with a container for holding a concentrated beverage, the container having an adapter which is resealably actuatable between an open position for allowing the beverage to flow from the container and a closed position for containing the beverage, the dispenser comprising:

a housing having a chamber for holding a container in a fixed position;

a dispenser valve including:

an engaging mechanism for engaging the adapter, and a switch operable between a first position in which the engaging means causes the adapter to be in the open position and a second position in which the adapter is maintained in the closed position; and means for combining the concentrated beverage and water.

7. The dispenser of claim 6 wherein the adapter has a spring loaded ball valve, and the engaging mechanism includes a pin.

8. The dispenser of claim 7 wherein the switch comprises a manually rotatable handle for causing the pin to move vertically.

9. The dispenser of claim 8 further comprising a conduit for providing rinse water into the dispenser valve through an opening in the valve, the opening being aligned with the conduit when the adapter is in the closed position, the opening being out of alignment with the conduit when the adapter is in a closed position.

10. A beverage dispenser for use with a container for holding a liquid, the container having an adapter which is mechanically actuatable between an open position in which the liquid can flow and a closed position in which the liquid is contained, the dispenser comprising:

a housing having a chamber for holding at least one container with liquid;

means for holding the container at a specified height in the chamber;

a dispenser valve including:

a support rigidly mounted in the housing under and at a fixed distance from the container, a movable engaging mechanism coupled to the support for actuating the adapter between the open and closed positions, and an engaging switch for moving the engaging mechanism.

11. The dispenser of claim 10 wherein the engaging switch causes the engaging mechanism to move vertically into physical contact with the adapter.

12. The dispenser of claim 10 further comprising a conduit for providing rinse water to the valve, wherein the engaging mechanism is a pin mounted in a rotatable cup, the cup having an opening which is aligned with the conduit when the adapter is in the closed position, and non-aligned when the adapter is in the open position.

* * * * *